US005906356A

United States Patent [19]

Stratman

[11] Patent Number: 5,906,356

[45] **Date of Patent: *May 25, 1999**

[54] ADJUSTABLE LIFTING APPARATUS

[76] Inventor: Cletus J. Stratman, 3706 Union Rd, St. Louis, Mo. 63125

[ * ] Notice: This patent issued on a continued prosecution application filed under 37 CFR 1.53(d), and is subject to the twenty year patent term provisions of 35 U.S.C. 154(a)(2).

[21] Appl. No.: 08/735,251

[22] Filed: Oct. 22, 1996

[51] Int. Cl.[6] ..... B66F 3/18

[52] U.S. Cl. ..... 254/103

[58] Field of Search ..... 254/98, 99, 100, 254/103, 133, 134, 425, 420

[56] References Cited

U.S. PATENT DOCUMENTS

| | | | |
|---|---|---|---|
| Re. 30,533 | 3/1981 | Dushku . | |
| 192,554 | 6/1877 | Winters . | |
| 502,397 | 8/1893 | Lemons . | |
| 833,331 | 10/1906 | Michaelis . | |
| 891,988 | 6/1908 | Hardy . | |
| 1,047,193 | 12/1912 | Fox et al. . | |
| 1,093,405 | 4/1914 | Hallen . | |
| 1,129,494 | 2/1915 | Kelleher . | |
| 1,176,513 | 3/1916 | Bell . | |
| 1,520,630 | 12/1924 | Bateman . | |
| 1,557,344 | 10/1925 | Schuh . | |
| 2,359,016 | 9/1944 | Wood . | |
| 2,508,661 | 5/1950 | Campbell . | |
| 2,706,057 | 4/1955 | Belding . | |
| 2,738,952 | 3/1956 | Nilson | 254/99 |
| 2,823,551 | 2/1958 | Utz . | |
| 2,897,989 | 8/1959 | Hounsell . | |
| 2,994,939 | 8/1961 | Matthews . | |
| 3,010,592 | 11/1961 | Chadwick . | |
| 3,145,863 | 8/1964 | Dunaski . | |
| 3,314,656 | 4/1967 | Haines . | |
| 3,327,996 | 6/1967 | Morse . | |
| 3,409,272 | 11/1968 | Rasmussen . | |
| 3,486,650 | 12/1969 | Boone . | |
| 3,570,694 | 3/1971 | Tantlinger . | |
| 3,672,634 | 6/1972 | Chaffin . | |
| 3,797,460 | 3/1974 | Blankenship . | |
| 3,941,352 | 3/1976 | Nehrig et al. . | |
| 4,050,672 | 9/1977 | Lane . | |
| 4,073,475 | 2/1978 | Gordon . | |
| 4,078,774 | 3/1978 | Williams . | |
| 4,183,511 | 1/1980 | Marek | 254/100 |
| 4,432,521 | 2/1984 | Bevans et al. . | |
| 4,491,452 | 1/1985 | Matovich . | |
| 4,593,883 | 6/1986 | Nelson . | |
| 4,659,072 | 4/1987 | De La Rosa . | |
| 4,846,443 | 7/1989 | Collins et al. . | |
| 4,902,191 | 2/1990 | Cumbest et al. . | |
| 4,934,893 | 6/1990 | Johnson . | |
| 4,971,292 | 11/1990 | Craig . | |
| 5,131,629 | 7/1992 | Hillhouse . | |
| 5,135,205 | 8/1992 | Bedard . | |
| 5,181,694 | 1/1993 | Collins . | |
| 5,234,197 | 8/1993 | Wurdack . | |
| 5,261,643 | 11/1993 | Wurdack . | |
| 5,273,256 | 12/1993 | Chambers . | |
| 5,385,335 | 1/1995 | Wurdack | 254/133 R |
| 5,447,386 | 9/1995 | Wurdack . | |
| 5,490,757 | 2/1996 | Stratman . | |
| 5,628,610 | 5/1997 | Stratman . | |

FOREIGN PATENT DOCUMENTS

| | | |
|---|---|---|
| 545022 | 8/1957 | Canada . |
| 828631 | 2/1960 | United Kingdom . |
| 1455636 | 11/1976 | United Kingdom . |
| 2060555 | 5/1981 | United Kingdom . |

*Primary Examiner*—Robert C. Watson
*Attorney, Agent, or Firm*—Seulthaus & Walsh PC

[57] ABSTRACT

An adjustable lifting apparatus preferably for applications in which a floor covering is to be removed and/or installed. The apparatus comprises multiple gear means which are capable of providing mechanical leverage while raising and/or lowering connecting means which attach the apparatus to the object to be lifted.

28 Claims, 8 Drawing Sheets

ADJUSTABLE LIFTING APPARATUS

BACKGROUND OF THE INVENTION

The present invention relates in general to lifting devices and pertains, more particularly to hand cranked vertical support systems utilizing gear means to provide mechanical advantage in lifting furniture systems (e.g., modular office systems that could include walls and furniture). The adjustable lifting apparatus of this invention provides an improvement over the conventional support systems used to raise office partitions.

The present invention is characterized by first gear means for converting rotary motion into linear motion, second gear means for transmitting motion and power between the first gear means and a shaft located at a right angle to the first gear means, enclosing means, supporting means, and connecting means including interchangeable fittings which are capable of being attached to an object to be lifted.

With the conventional support systems, which typically utilize a crowbar like tool, it is generally necessary to continually lift and then lower, and then move the tool and lift again when installing carpeting either by the yard or in tiles. The same drawback occurs when removing carpeting, tile, or other type or styles of flooring. As the size of the project increases a drawback associated with conventional methods and devices occurs due to the time it takes to complete the project.

Since existing methods and tools for installing flooring generally require the removal of a substantial amount of furniture, a business may have to either shut down during the project to have the furniture, partitions, file cabinets and the like moved twice, once to clear an area for removal and replacing and again to replace the furniture. Another drawback that occurs relates to the additional costs that are not related to the actual flooring project.

Known devices include a moveable fulcrum pin for adjusting the height of a lever supported by a stand or an upright frame supported on a base block, or a base member with outwardly extending wings, or a plurality of vertical standards supported by a base member. Prior devices are used in automobile jacks, window lifting devices, and lifting devices in general. The existing jacks and jacking devices also have a drawback in that they provide a jack that is not particularly suited or adaptable to uses other than those for which the jack is intended.

SUMMARY OF THE INVENTION

Accordingly, it is an object of the present invention to provide an adjustable lifting apparatus that can accommodate lifting a variety of furniture systems in substantially space-restricted surroundings. The adjustable lifting apparatus of this invention makes it possible to install flooring at a rate substantially greater than that previously possible.

Another object of the present invention is to provide an adjustable lifting apparatus that is constructed to provide a uniform and repeatable process during flooring installation and thus to provide an expedient method that promotes an efficient use of time and labor.

Still another object of the present invention is to provide an adjustable lifting apparatus that may be readily used with a variety of different furniture systems. The adjustable lifting apparatus of this invention is preferably provided with one or more fittings which are interchangeable thereby allowing the use of the adjustable lifting apparatus on different styles of office furnishings.

Still a further object of the present invention is to provide a lifting apparatus that is adapted for use in lifting and holding an object, such as a furniture member, particularly a partition member, while flooring is being both removed and installed. The adjustable lifting apparatus of this invention is characterized by the capability of lifting the furnishing from a minimally offset position so as to allow either removal or replacement of flooring directly underneath the lifted section of the office furnishings.

Another object of the present invention is to provide a lifting apparatus that is substantially portable such that it can be readily moved from job-site to job-site and used as disclosed in the following specification.

Still another object of the present invention is to provide an adjustable lifting apparatus having gear means for converting rotary motion into linear motion in order to provide for mechanical advantage in a tool that is relatively compact and still easy to manufacture and assemble.

A further object of the present invention is to provide an adjustable lifting apparatus having a housing and a lifting apparatus that is operable in any orientation, for example, while upside down. The lifting apparatus of this invention can be used in locations unreachable by other lifting devices that operate as intended only when used in an upright or generally upright position.

Still another object of the present invention is to provide an adjustable lifting apparatus having a unique ornamental design. The ornamental design includes a longitudinal housing, a foot located at one end of the housing, and an adjustable support member located at an opposite end of the housing.

To accomplish the foregoing and other objects of this invention there is provided an adjustable lifting apparatus that provides mechanical leverage through gear means in order to lift a furniture system (e.g., modular office system that can include walls and furniture).

In operation, the adjustable lifting apparatus is used to lift the furniture so that the carpet can be replaced, preferably with carpet tiles. The supporting means in combination with the stabilizing means allows for off-set capability such that the carpet directly beneath the furniture can be replaced without interference from the adjustable lifting apparatus.

The adjustable lifting apparatus is used repeatedly to lift the furniture and replace the carpet until the entire carpet has been replaced. Due to its design, the lifting apparatus operates in either and upright, upside down or any other orientation required to lift or move an object to allow the installation, and removal if required, of a floor covering, such as a carpet tile or square typically used as a floor covering in offices.

The adjustable lifting apparatus comprises first gear means for converting rotary motion into linear motion, second gear means for transmitting motion and power between the first gear means and a shaft preferably located at a right angle to the first gear means. The shaft is constructed to receive a handle or other suitable cranking device.

An enclosing means or housing substantially encloses both the first and the second gear means and support means and a connecting means provides for attaching the adjustable lifting apparatus to an object to be lifted. The connecting means is supported such that use of the connecting means does not depend upon the orientation of the adjustable lifting apparatus.

These and other objects and features of the present invention will be better understood and appreciated from the following detailed description of one embodiment thereof, selected for purposes of illustration and shown in the accompanying drawings.

DETAILED DESCRIPTION

Figure 1:
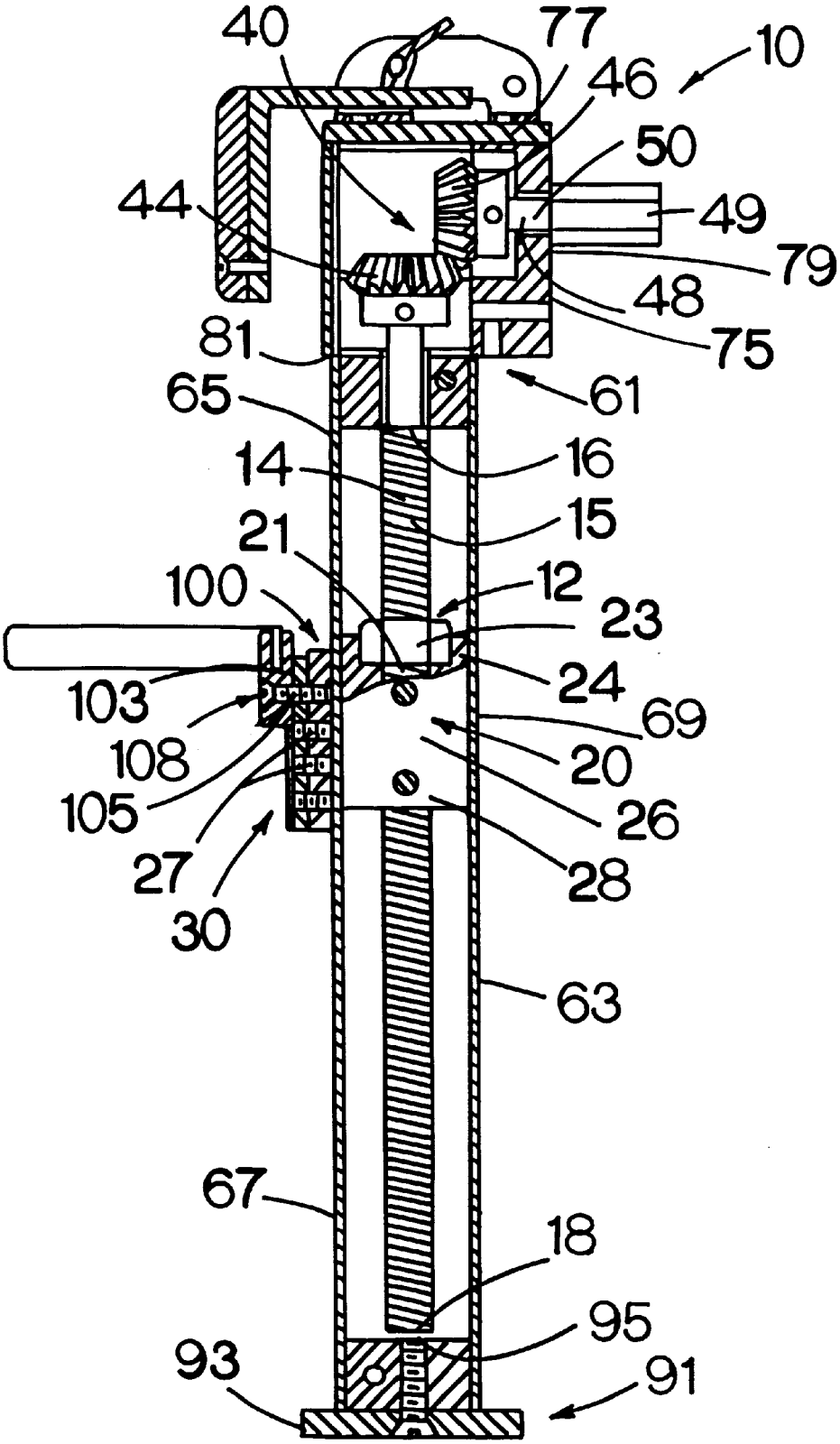
FIG. 1 is a cutaway side view of the adjustable lifting apparatus having a preferred fitting for connecting the adjustable lifting apparatus to an object to be lifted.
Figure 5:
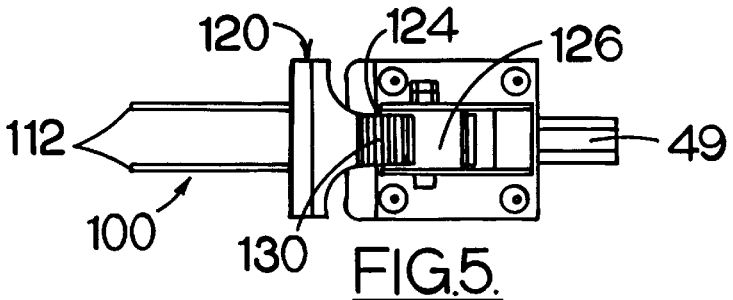
FIG. 5 is a top view of the adjustable lifting apparatus of FIG. 1.
Figure 2:
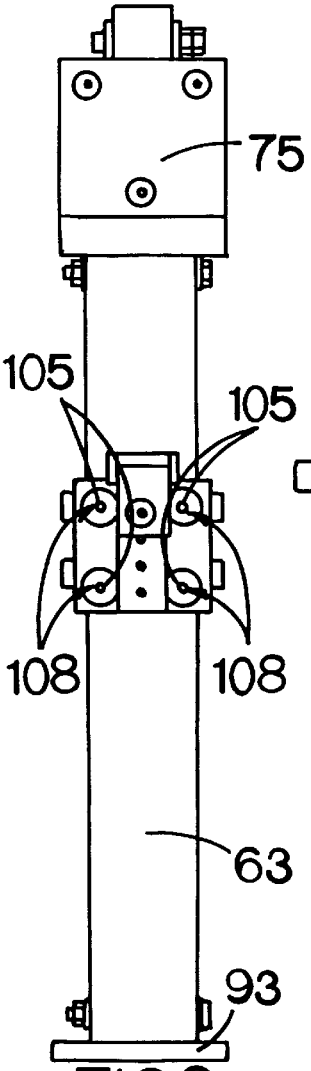
FIG. 2 is a front view of the adjustable lifting apparatus of FIG. 1.
Figure 3:
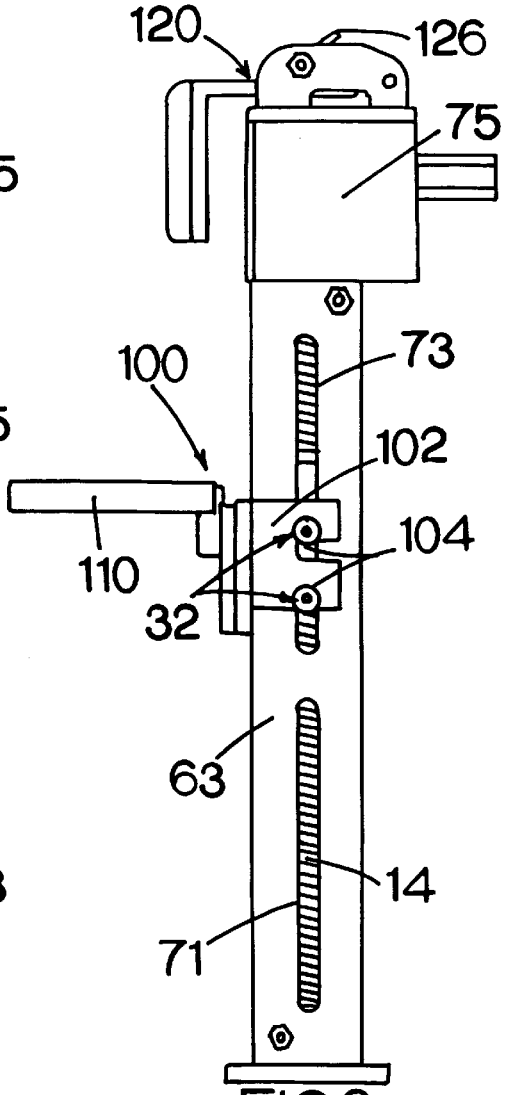
FIG. 3 is a side view of the adjustable lifting apparatus of FIG. 1.
Figure 4:
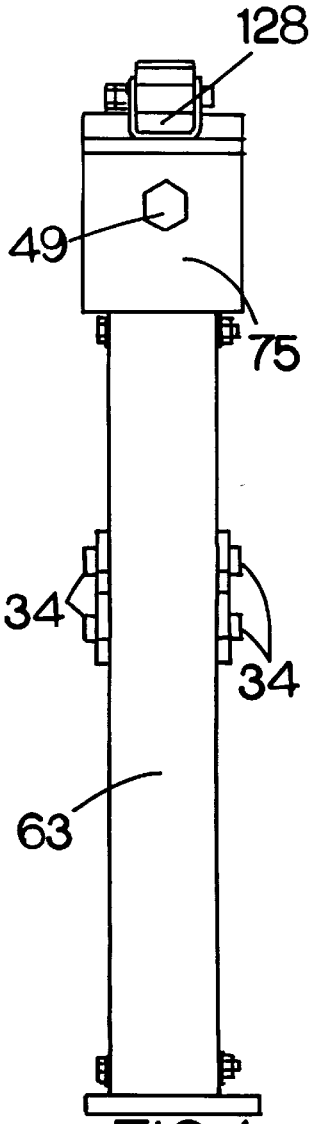
FIG. 4 is a rear view of the adjustable lifting apparatus of FIG. 1.
Figure 7:
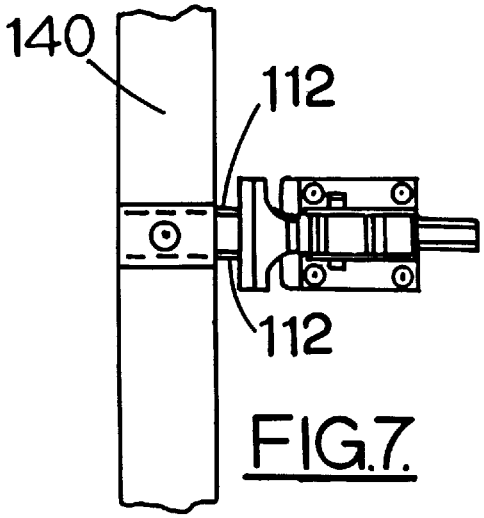
FIG. 7 is a top view of the adjustable lifting apparatus of FIG. 1 in combination with a typical object to be lifted.
Figure 6:
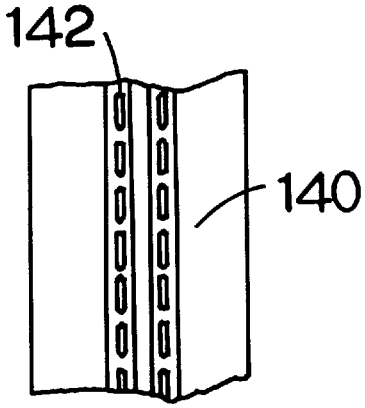
FIG. 6 is side view of attachment receptacles of a typical object to be lifted.
Figure 8:
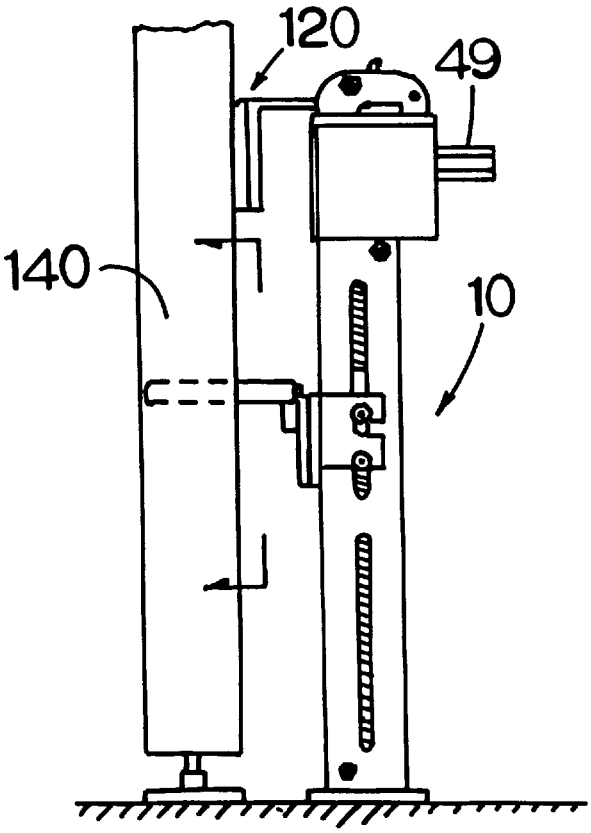
FIG. 8 is a side view of the adjustable lifting apparatus of FIG. 1 in combination with a typical object to be lifted, FIG. 8 illustrating the object in a before lifted position.
Figure 9:
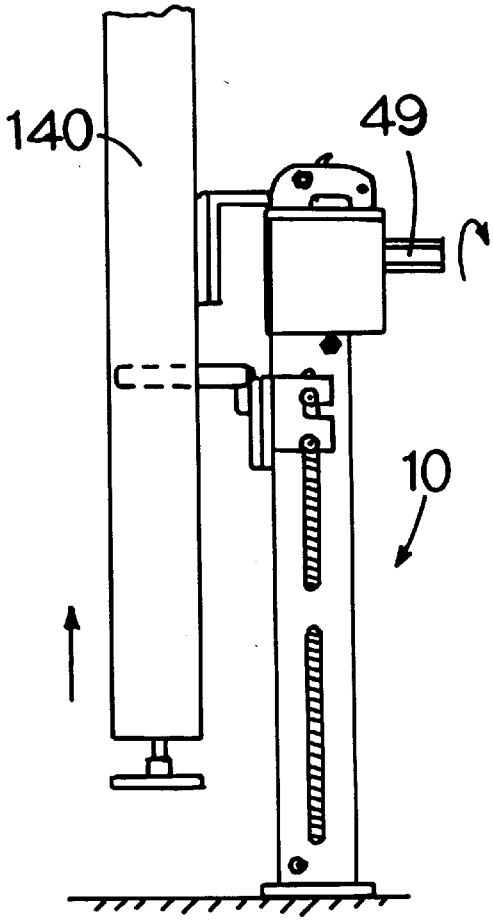
FIG. 9 is a side view of the adjustable lifting apparatus of FIG. 1 in combination with a typical object to be lifted, FIG. 9 illustrating the object in an after lifted position.
Figure 10:
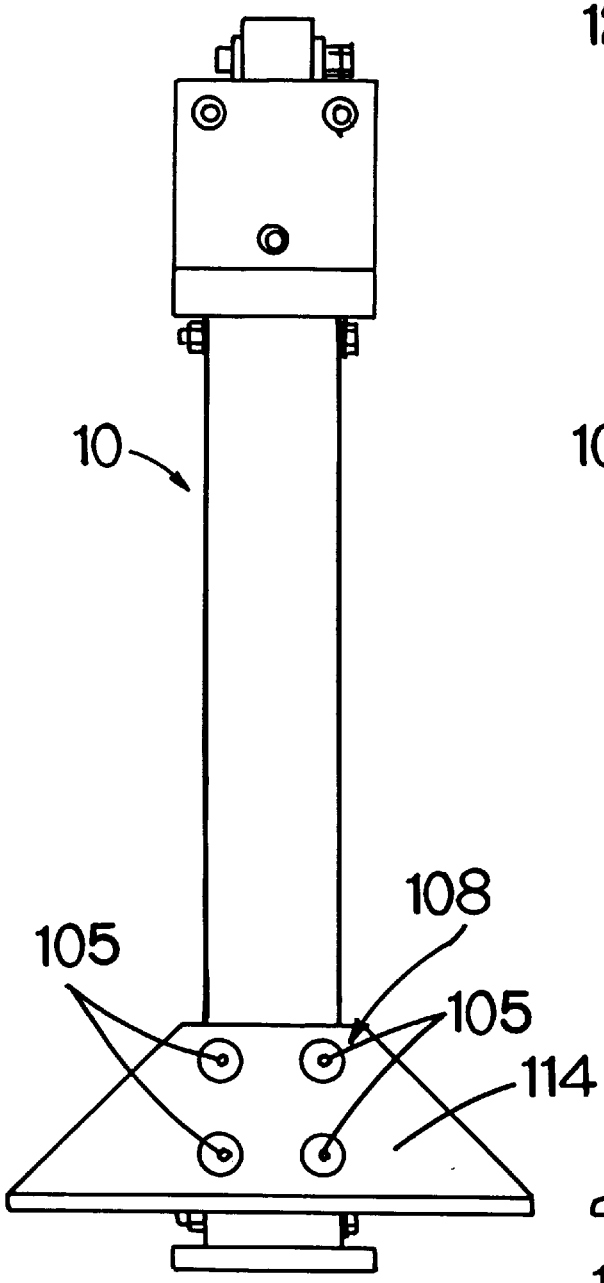
FIG. 10 is a front view of the adjustable lifting apparatus illustrating an alternate fitting for connecting the adjustable lifting apparatus to the object to be lifted.
Figure 11:
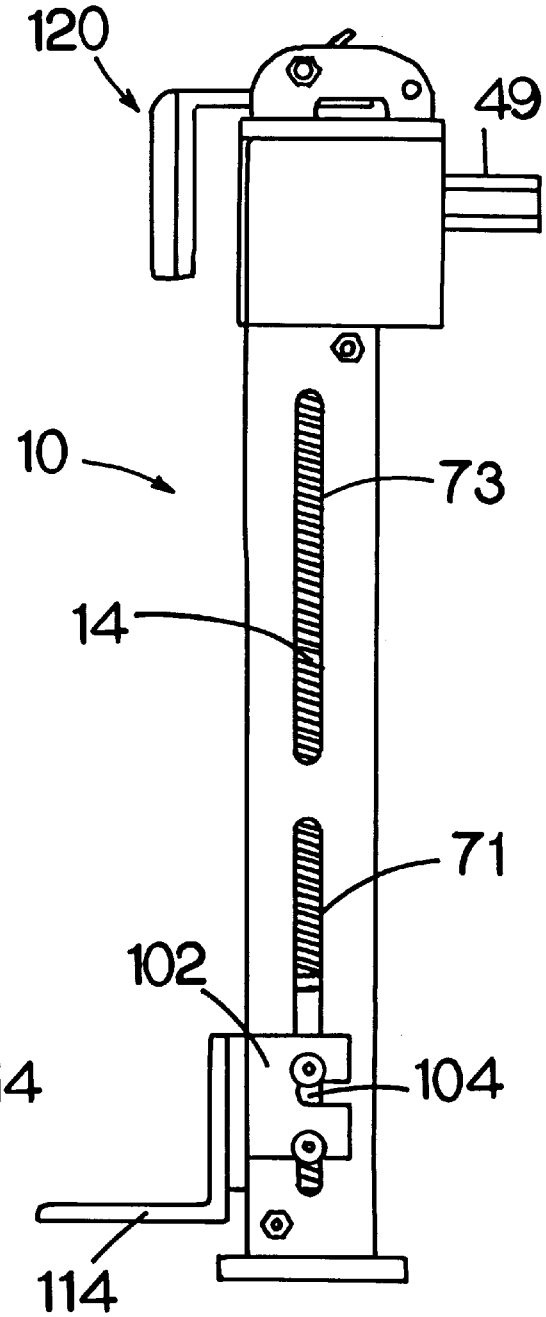
FIG. 11 is a side view of the adjustable lifting apparatus of FIG. 10.
Figure 12:
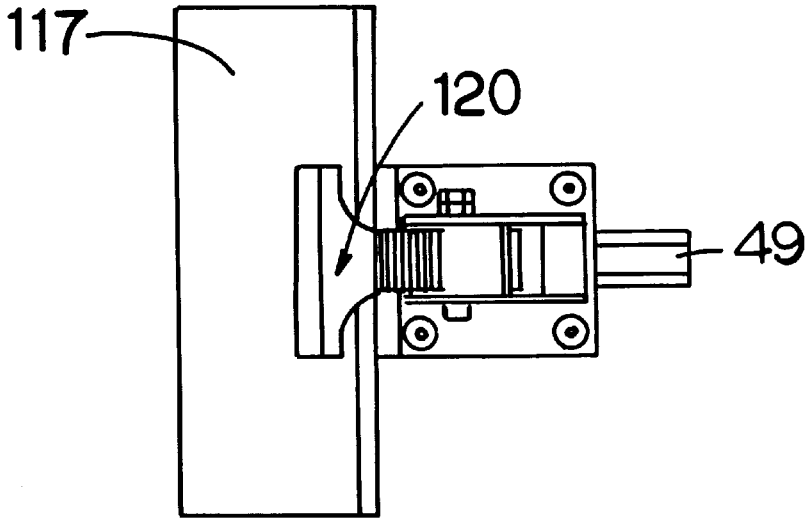
FIG. 12 is a top view of the adjustable lifting apparatus of FIG. 10 in combination with a typical object to be lifted.
Figure 13:
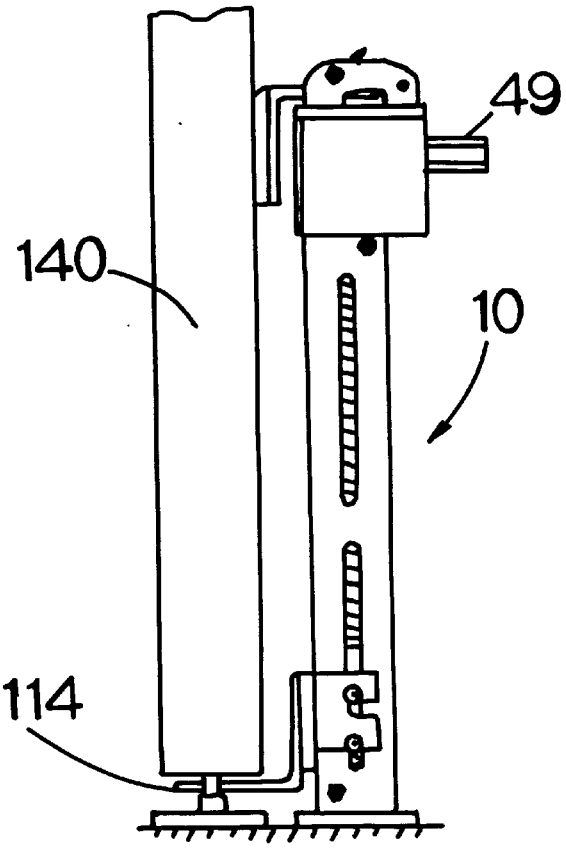
FIG. 13 is a side view of the adjustable lifting apparatus of FIG. 10 in combination with a typical object to be lifted, FIG. 13 illustrating the object in a before lifted position.
Figure 14:
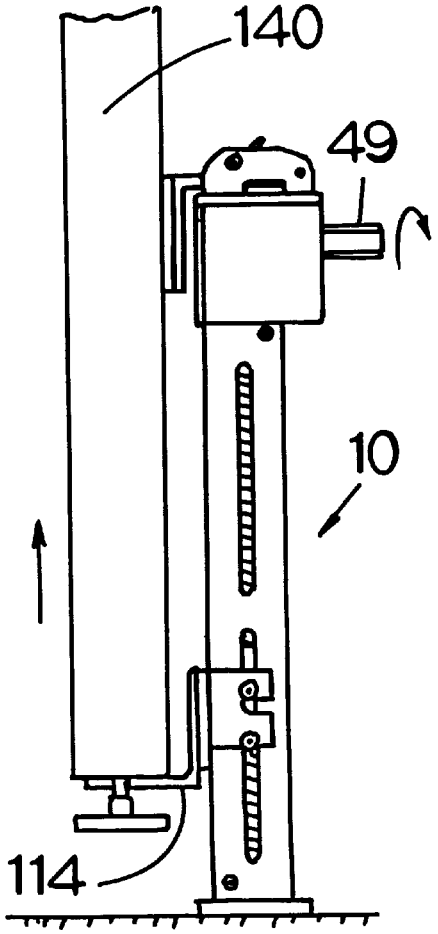
FIG. 14 is a side view of the adjustable lifting apparatus of FIG. 10 in combination with a typical object to be lifted, FIG. 14 illustrating the object in an after lifted position.

Referring now to the drawings, there is shown and described a preferred embodiment for the adjustable lifting apparatus of this invention in connection with lifting and lowering office furniture partitions. The adjustable lifting apparatus of the present invention is particularly adapted for lifting and supporting an office furniture partition or other similar object or piece of furniture found in an office setting so as to allow the installation or removal and installation or the removal of a floor covering and is characterized by an improved lifting and supporting mechanism and lowering mechanism as well as suitable brackets or attachments for engaging or lifting the office furniture partition or other similar object or piece of furniture requiring lifting.

The adjustable lifting apparatus 10 comprises first gear means 12 for converting rotary motion into linear motion, second gear means 40 for transmitting motion and power between the first gear means 12 and a shaft 48 located at a right angle to the first gear means 12. An enclosing means 61 is provided for substantially enclosing both the first and the second gear means, a support means 91 and a connecting means 100 for attaching the adjustable lifting apparatus to an object 140 to be lifted.

The first gear means 12 further comprises an elongated threaded member 14 in combination with at least one follower block 20. The elongated threaded member 14 has an end 16 and an opposite end 18 and in a preferred embodiment, the elongated threaded member 14 comprises a worm screw 15.

The one or more follower blocks 20 have an end 24, an intermediate portion 26 including a plurality of threaded apertures 27 for receiving a plurality of attachment members 30, and an opposite end 28. The one or more follower blocks 20 have a threaded aperture 22.

In one preferred embodiment, the threaded aperture 22 extends from the end 24 to the opposite end 28 of the single follower block 20 illustrated in association with one preferred of the present invention. The threaded aperture 22 receives the threaded member 14.

In another preferred embodiment, the one illustrated follower block 20 has an aperture 21 extending from the end 24 to the opposite end 28 and a nut 23 with a threaded aperture 25 attached to the one illustrated follower block 20. The nut 23 is attached to the one follower block 20 illustrated in the drawings such that the threaded aperture 25 of the nut 23 and the aperture 21 share a common axis and both the threaded aperture 25 and the aperture 21 are capable of receiving the elongated threaded member 14.

Rotating the elongated threaded member 14 causes the one illustrated follower block 20 (the same as it would is there were more than one follower blocks as is the case for all of the described, illustrated and claimed features of the one follower block illustrated and described) to move linearly along the elongated threaded member 14 from the end 16 to the opposite end 18 or vice versa, or until the movement is restricted by a pair of elongated apertures 71, 73 of the enclosing means 61. The plurality of attachment members 30 preferably comprise a plurality of thumb screws 32 each having a threaded shaft portion 36 and a head portion 34.

The second gear means 40 comprises a first gear member 44 and a second gear member 46. Preferably the first gear member 44 and the second gear member 46 comprise 45 degree miter gears having a 20 degree pressure angle.

The first gear member 44 is rigidly attached to the end 16 of the elongated threaded member 14. Alternatively, the first gear member 44 can be attached to a shaft which is in turn attached to the end 16 of the elongated threaded member 14.

The second gear member 46 is rigidly attached to an end portion 50 of a shaft 48 located at a right angle to the elongated threaded member 14. The shaft 48 has an opposite end portion 49 capable of receiving a crank member 52 for facilitating turning of the shaft 48 and thereby raising and/or lowering the adjustable lifting apparatus 10.

In a preferred embodiment, the opposite end portion 49 of the shaft 48 has a hexagonal cross section such that a conventional wrench is also capable of turning the shaft 48. The shaft extends out from an enclosure or housing so as to allow the wrench to access the shaft and operate the lifting device of the present invention.

The enclosing means 61 for substantially enclosing both the first and the second gear means comprises an elongated first housing member 63 substantially enclosing the first gear means 12 and a second housing member 75 substantially enclosing the second gear means 40.

The elongated first housing member 63 having an end portion 65, an intermediate portion 69 having a pair of first elongated apertures 71 and a pair of second elongated apertures 73, and an opposite end portion 67. The pair of first elongated apertures 71 and the pair of second elongated apertures 73 receiving the plurality of attachment members 30 of the at least one follower block 20 substantially enclosed by the elongated first housing member 63.

In a preferred embodiment, the intermediate portion 69 has two first elongated apertures 71 and two second elongated apertures 73 opposite the two first elongated apertures 71, respectively. The pair of first elongated apertures 71 and the pair of second elongated apertures 73 provide for extended height adjustability in that the at least one follower block 20 can be easily repositioned with respect to the elongated threaded member 14 by an end user.

The pair of first elongated apertures 71 and the pair of second elongated apertures 73 are capable of receiving the plurality of attachment members 30 of the at least one follower block 20 substantially enclosed by the elongated first housing member 63.

In the preferred embodiment, in which the plurality of attachment members 30 comprise a plurality of thumb screws 32 having a threaded shaft portion 36 and a head portion 34, the threaded shaft portion 36 slides within either the pair of first elongated apertures 71 or the pair of second elongated apertures 73, as the at least one follower block 20 moves linearly along the elongated threaded member 14. The head portion 34 extends through either the pair of first elongated apertures 71 or the pair of second elongated apertures 73 such that the head portion 34 is not enclosed by the elongated first housing member 63 and is therefore capable of removably receiving the connecting means 100.

In a preferred embodiment, the elongated first housing member 63 is comprised of substantially square tubing. In an alternate embodiment, the elongated first housing member 63 is comprised of substantially round tubing.

The second housing member 75 having a top portion 77, an intermediate portion 79, and a bottom portion 81. The bottom portion 81 of the second housing member 75 is pivotably attached to the end portion 65 of the elongated first housing member 63. The second housing member 75 is attached to the elongated first housing member 63 off-center such that when the second housing member 75 is pivoted, a portion of the second housing member 75 extending outside a perimeter of the elongated first housing member 63 can be selected with respect to the orientation of the adjustable lifting apparatus 10. The pivotable second housing member 75 allows the adjustable lifting apparatus 10 to be placed in close proximity to the object 140 to be lifted.

The second housing member 75 is capable of being substantially secured to the elongated first housing member 63 by fastening means. Preferably the fastening means comprise one or more nut and bolt combinations.

The supporting means 91 comprising a foot or a base member 93 pivotable attached to the opposite end portion 67 of the elongated first housing member 63. The base member 93 is attached to the elongated first housing member 63 off-center such that when the base member 93 is pivoted, a portion of the base member 93 extending outside a perimeter of the elongated first housing member 63 can be selected with respect to the orientation of the adjustable lifting apparatus 10. The adjustable base member 93 in combination with the pivotable second housing member 75 allows the adjustable lifting apparatus 10 to be placed in close proximity to the object 140 to be lifted while still providing substantial stability.

The base member 93 capable of being substantially secured to the elongated first housing member 63 by fastening means. Preferably the fastening means comprise one or more nut and bolt combinations.

The base member 93 having a cavity 95 for receiving the opposite end 18 of the elongated threaded member 14. The elongated threaded member 14 capable of being rotated via the shaft 48 while the opposite end 18 is stabilized within the cavity 95.

The connecting means 100 comprising at least one substantially U-shaped carrier 102 having a plurality of notches 104, which are capable of receiving the plurality of attachment members 30 such that a portion of the elongated first housing member 63 is slidably received by the at least one substantially U-shaped carrier 102, and one or more fittings 106 removably attached to the at least one substantially U-shaped carrier 102. The one or more fittings 106 capable of engaging the object 140 to be lifted.

In one preferred embodiment, the one or more fittings 106 comprising a forked member 110 having two or more tines 112 spaced in a substantially horizontal line. The two or more tines 112 capable of being received in two or more receptacles 142 spaced in a substantially horizontal line of the object 140 to be lifted.

In another preferred embodiment, the one or more fittings 106 comprising a substantially L-shaped member 114 capable of fitting underneath the object 140 to be lifted in a substantially horizontal line.

The one or more fittings 106 are removable attached to the at least one substantially U-shaped carrier 102 by fastening means 108.

In one preferred embodiment, the fastening means 108 comprise one or more threaded fasteners 105 received within one or more threaded apertures 103 of the substantially U-shaped carrier 102.

Figure 15:
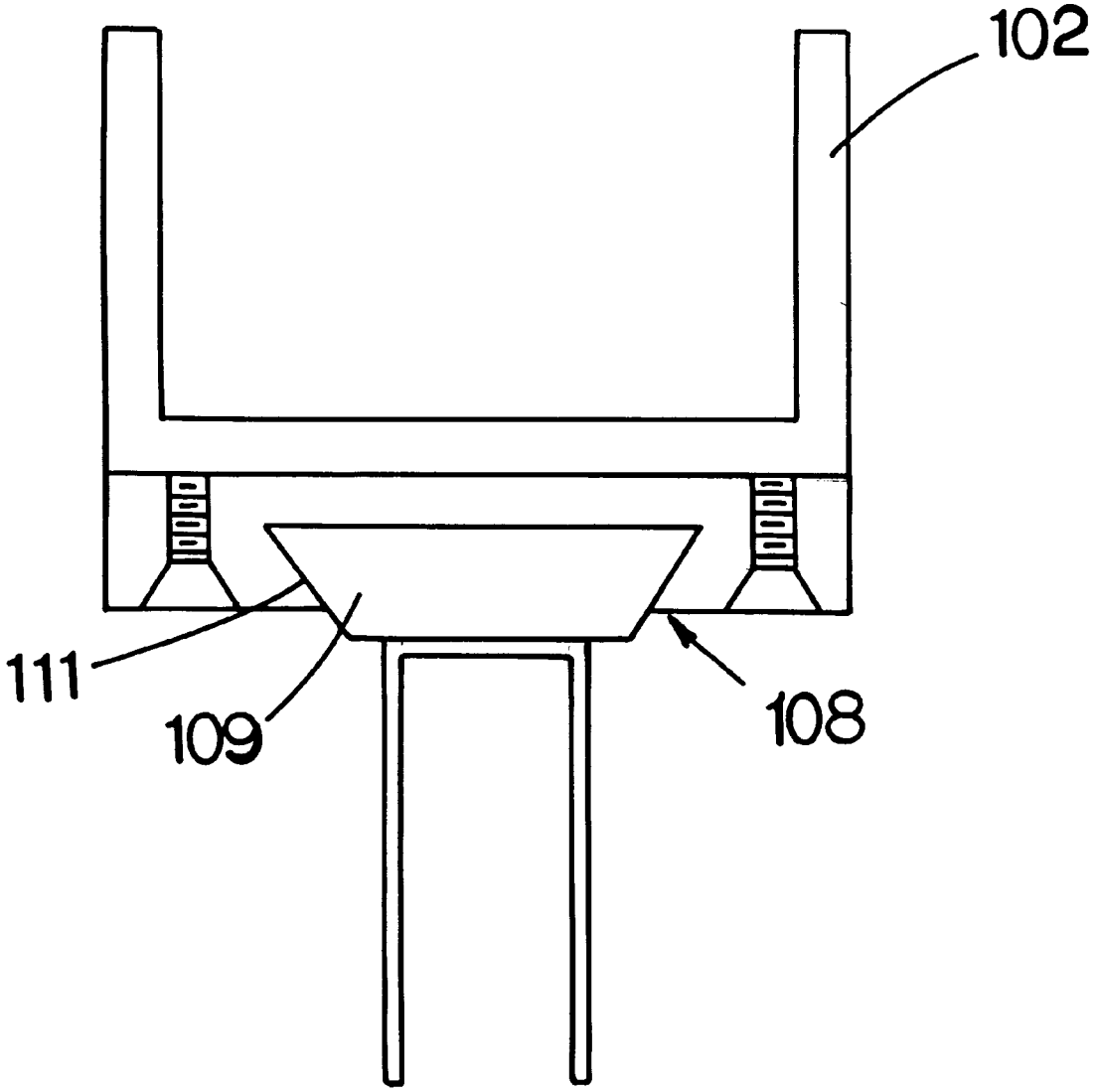
FIG. 15 is a top view of the connecting means illustrating another preferred fastening means for removably attaching the one or more fittings to the substantially U-shaped carrier.

In another preferred embodiment as illustrated in FIG. 15, the fastening means 108 comprise a dovetail slot 111 of the substantially U-shaped carrier 102 in combination with a dovetail key 109 of the one or more fittings 106, the dovetail slot 111 capable of slidably receiving the dovetail key 109 such that the fitting 106 is removably attached to the at least one substantially U-shaped carrier 102.

In a preferred embodiment, the adjustable lifting apparatus 10 further comprises stabilizing means 20 adjustably attached to the top portion 77 of the second housing member 75. The stabilizing means 20 is capable of substantially stabilizing the adjustable lifting apparatus 10. The stabilizing means 20 comprising a substantially L-shaped stabilizing arm 122 having a plurality of grooves 130, and locking means 124.

The locking means 124 comprising the plurality of grooves 130 of the substantially L-shaped stabilizing arm 122 in combination with a U-shaped frame member 123 attached to the top portion 77 of the second housing member 75, a release lever 126 pivotably attached to the U-shaped frame member 123, and spring means 128 for biasing the release lever 126, the substantially L-shaped stabilizing arm 122 capable of being adjustably received within the U-shaped frame member 123 such that the plurality of grooves 130 of the substantially L-shaped stabilizing arm 122 are capable of receiving the release lever 126.

In operation, the adjustable lifting apparatus 10 is placed in substantially close proximity to the object 140 to be lifted.

A fitting 106 is selected which preferably can either be received within a receptacle 142 of the object 140 to be lifted, such as the forked member 110 having two or more tines 112 spaced in a substantially horizontal line, or positioned underneath the object 140 to be lifted in a substantially horizontal line, such as the substantially L-shaped member 114. The fitting 106 is removably attached to the at least one substantially U-shaped carrier 102 of the lifting apparatus 10.

The off-center mounted second housing member 75 is pivoted with respect to the elongated first housing member 63 such that the shaft 48 is capable of being rotated and the adjustable lifting apparatus 10 is minimally offset from the object 140 to be lifted. The off-center mounted base member 93 is pivoted with respect to the elongated first housing member 63 such that the adjustable lifting apparatus 10 is substantially supported and minimally offset from the object 140 to be lifted.

The fitting 106 is either inserted into the receptacle 142 or underneath the object 140 to be lifted, respectively.

In a preferred embodiment, the stabilizing means 120 is positioned alongside the object 140 to be lifted. The release lever 126 is released and the substantially L-shaped stabilizer arm 122 is slid, within the U-shaped frame member 123 attached to the top portion 77 of the second housing member 75, towards the object 140 to be lifted. Upon substantial contact of the substantial L-shaped stabilizer arm 122 with the object 140, the release lever 126 is released and biased within the plurality of grooves 130 of the substantial L-shaped stabilizer arm 122 thereby substantially locking the stabilizing means 120.

The shaft 48 is rotated, either with a crank member 52 or a conventional wrench, which causes the second gear member 46 to rotate, which in turn rotates the first gear member 44 located at a right angle to the second gear member 46.

The rotation of the first gear member 44 causes the elongated threaded member 14 to rotate within the cavity 95 of the base member 93. The rotation of the elongated threaded member 14 causes the at least one follower block 20 and the attached U-shaped carrier 102 and fitting 106 to move linearly along the axis of the elongated threaded member 14.

The linear movement of the at least one follower block 20 is restricted by either the pair of first elongated apertures 71 or the pair of second elongated apertures 73 of the intermediate portion 69 of the elongated first housing member 63. The plurality of attachment members 30 of the at least one follower block 20 extend through the elongated apertures such that they can be received by the plurality of notches 104 of the U-shaped carrier 102.

In a preferred embodiment, the linear movement of the at least one follower block 20 and the plurality of attachment members 30 within either of the elongated apertures 71, 73 is approximately 6.0 inches. However, the plurality of attachment members 30 of the at least one follower block 20 can be removed so that the at least one follower block 20 can be positioned within either the pair of first elongated apertures 71 or the pair of second elongated apertures 73.

When the at least one follower block 20 is positioned within the pair of first elongated apertures 71, the forked member 110 fitting is capable of engaging the object 140 at a receptacle 142 located approximately 1.5 to 7.5 inches above the floor, and the substantially L-shaped member 114 fitting is capable of engaging the object 140 at floor level to approximately 6.0 inches above the floor.

When the at least one follower block 20 is positioned within the pair of second elongated apertures 73, the forked member 110 fitting is capable of engaging the object 140 at a receptacle 142 located approximately 8.25 to 14.25 inches above the floor.

In another preferred embodiment a U-shaped carrier 150 has a front wall 152 and opposing side walls 154 and 156. The U-shaped carrier 150 is supported by thumb screws 32 or any other suitable extensions provided to support this or any other carrier as the lifting apparatus is moved as previously described.

Figure 16:
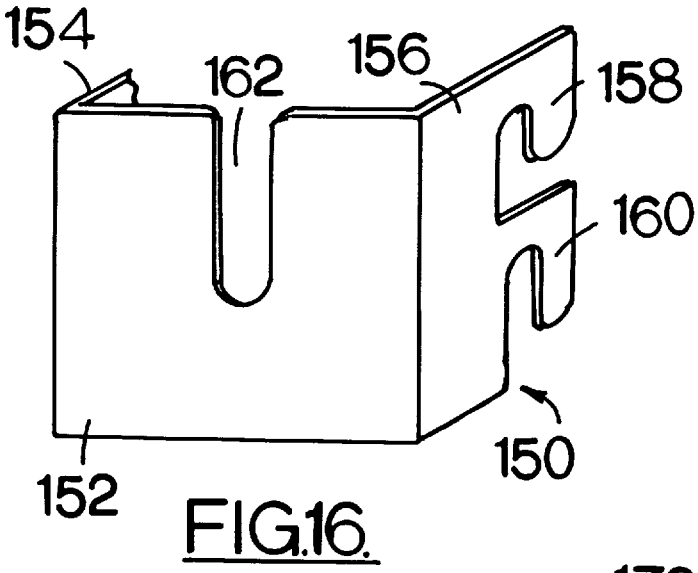
FIG. 16 is a perspective view of another embodiment of a U-shaped carrier.

In the embodiment illustrated in FIG. 16 the carrier is provided with a notch defining side wall portions 158 and 160. The side wall not shown has the same or similar structure.

Figure 18:
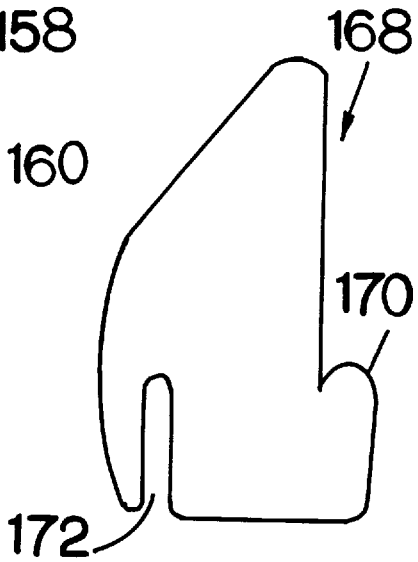
FIG. 18 is a side elevational view of another lifting attachment for use with the U-shaped carrier illustrated in FIG. 16.

The front wall 152 defines a lifting attachment receiving notch 162. Two lifting attachments are illustrated in FIG. 17 and FIG. 18.

Figure 17:
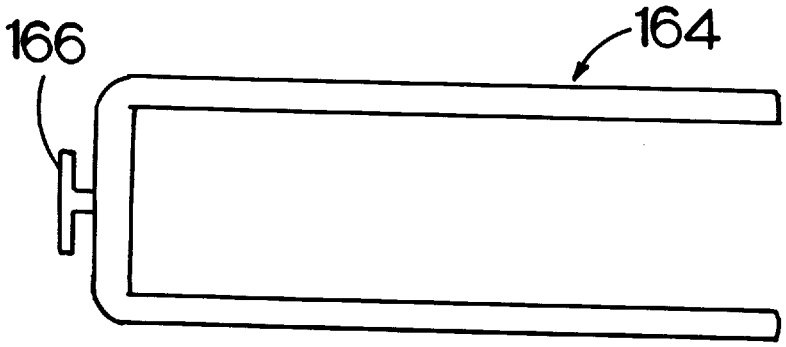
FIG. 17 is a plan view of a lifting attachment for use with the U-shaped carrier illustrated in FIG. 16.

The lifting attachment illustrated in FIG. 17 includes a U-shaped member 164 with engaging extensions and has a generally fork-like shape, including the pair of opposing tines illustrated in the drawing figure. A notch engaging extension 166 includes a button or disk-like member attached to the lifting attachment with a neck-like portion and the neck-like portion is received in the attachment receiving notch 162 to support the lifting attachment.

In some applications a single engaging member is needed. A preferred embodiment is illustrated in FIG. 18.

A generally planar lifting attachment 168 is shown that has means for supporting the load to be lifted and for being supporting by the lifting apparatus. Notch 170 engages the load being lifted and notch 172 engages attachment receiving notch 162 of U-shaped carrier 150.

Figure 20:
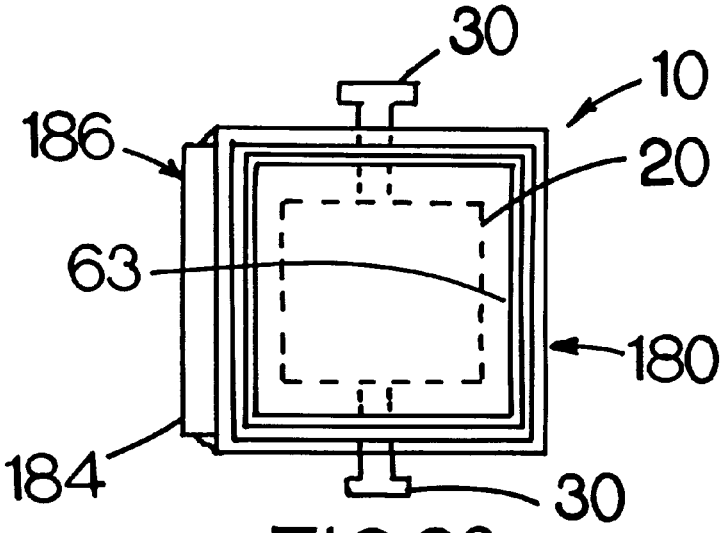
FIG. 20 is a top view of the preferred embodiment of the present invention illustrated in FIG. 19 in which the internal structure is not shown.
Figure 19:
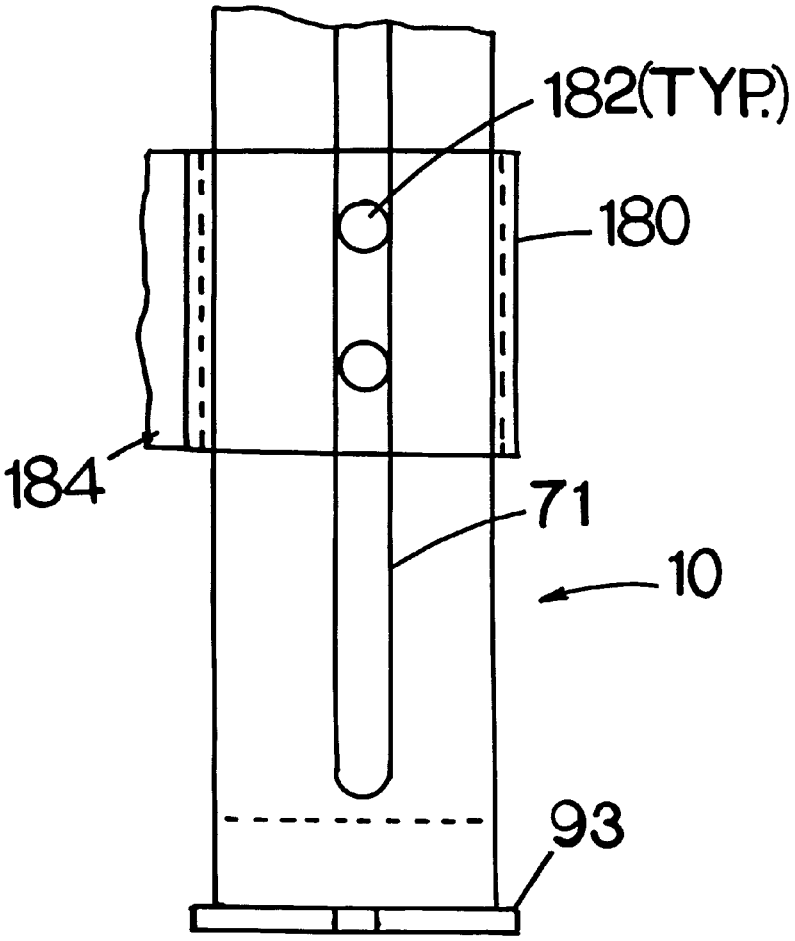
FIG. 19 is a side view of a further preferred embodiment of an adjustable lifting apparatus of the present invention illustrating a collar or sleeve located about the housing and used to strengthen and reinforce the attachment between the follower and connecting means in the adjustable lifting apparatus.

During development of the present invention it has been determined that a preferred embodiment will include a means for reinforcing the support of any connecting means used in combination with the invention. One form of reinforcement is illustrated in FIG. 19 and FIG. 20.

A means for reinforcing the supporting apparatus is provided in one preferred embodiment by using a sleeve 180 to replace the carrying means depicted, for example, by U-shaped carrier 102. Openings 182 are provided in the sides of the sleeve.

The same attachment members 30 can by used to connect the sleeve 180 to the follower block 20. A connecting means attachment plate 184 is attached (preferably by welding) to the sleeve 180.

All of the connecting means and brackets can be supported on the attachment plate. This can be accomplished in a variety of ways.

For example, the furniture facing portion of the previously described U-shaped carrier can be manufactured separately and attached to the attachment plate 184 by means of appropriately spaced connectors (e.g., threaded members) that extend through the modified U-shaped and received in mounting threaded openings 186.

In another embodiment, it now will be understood by one skilled in the art that the connecting means illustrated in FIG. 15 and FIG. 16, with minor modifications, can be provided with openings for receiving attachment members for attaching the modified connecting means to the attachment plate 184. It will be further understood by one skilled in the art upon recognizing the improvements that the present invention brings to the adjustable lifting art that the configuration of the sleeve 180 may be varied while still retaining its function and contribution to the desired operation of the present invention.

From the foregoing description those skilled in the art will appreciate that all of the objects of the present invention are realized. The adjustable lifting apparatus allows the lifting of sections of partitions, for example, which it will be recognized will increase the rate at which the flooring removal and/or installation can be accomplished since the furnishings effectively remain in place during the work and the resulting time and labor savings promotes an efficient use of time and labor.

By using the screw and follower arrangement in the present invention there is provided an adjustable lifting apparatus having a housing and a lifting apparatus that is operable in any orientation, for example, while upside down. Thus, the lifting apparatus of this invention can be used in locations unreachable by other lifting devices that operate as intended only when used in an upright or generally upright position.

The "housing and foot" style of the present invention provides an adjustable lifting apparatus having a unique ornamental design. This ornamental design includes, but is not limited to, the longitudinal housing, the foot located at one end of the housing, and the adjustable support member located at an opposite end of the housing.

As the fittings are interchangeable on either the U-shaped support or the sliding attachment plate, the adjustable lifting apparatus is adaptable for lifting furnishings of practically any design once a fitting with complementary extensions is designed. The lifting apparatus is portable and, with a variety of fittings, can be taken to any location along with the appropriate fittings and used as disclosed in the foregoing specification and illustrated in the accompanying drawings.

It will be understood that the present invention provides gear means for converting rotary motion into linear motion which provides additional mechanical advantage incorporated into the easy to manufacture, assemble, and use tool. The adjustable lifting apparatus is easy to use and readily adapted for a quick change of fittings when different style partitions need to be lifted or if a fitting breaks or bends out of shape.

While specific embodiments have been shown and described, many variations are possible. The particular shape of the members and the fittings including all dimensions may be changed as desired to suit the furnishings and the work space or area with which it is used.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. An adjustable lifting apparatus comprising:

first gear means for converting rotary motion into linear motion, the first gear means comprises an elongated threaded member in combination with at least one follower block having a threaded aperture for receiving the elongated threaded member;

second gear means for transmitting motion and power between the first gear means and a shaft located at a right angle to first gear means, the second gear means further comprise a first gear member meshed with a second gear member, the first gear member attached to the first gear means, the second gear member attached to an end portion of a shaft; means for substantially enclosing both the first gear means and the second gear means;

means for supporting both the first gear means and the second gear means;

means for connecting the first gear means to an object to be lifted; and the means for substantially enclosing both the first gear means the second gear means comprises an elongated first housing member substantially enclosing the first gear means, and a second housing member substantially enclosing the second gear means, the second housing member attached to the elongated first housing member, whereby the attachment between the second housing member and the first housing member provides for relative movement between the second housing member and the first housing member.

2. An adjustable lifting apparatus as set forth in claim 1 wherein the means for supporting both the first gear means and the second gear means comprises a base member attached to an opposite end portion of the elongated first housing member, whereby the attachment between the base member and the opposite end portion of the elongated first housing member provides for relative movement between the base member and the elongated first member.

3. An adjustable lifting apparatus as set forth in claim 1 wherein the means for connecting the first gear means to an object to be lifted includes a reinforcement member capable of receiving an attachment member of a follower block.

4. An adjustable lifting apparatus as set forth in claim 3 wherein the reinforcement member is a sleeve member.

5. An adjustable lifting apparatus as set forth in claim 4 wherein the sleeve member is a collar member located around the means for enclosing both the first gear means and the second gear means.

6. An adjustable lifting apparatus as set forth in claim 3 wherein the reinforcement member includes means for mounting connecting means.

7. An adjustable lifting apparatus as set forth in claim 3 wherein the reinforcement member is removably attached to the follower block and including means for supporting one or more fittings capable of mating with various components of furniture systems such that furniture can be substantially lifted by the adjustable lifting apparatus.

8. An adjustable lifting apparatus as set forth in claim 1 wherein the means for connecting the first gear means to an object to be lifted comprise at least one substantially U-shaped carrier and one or more fittings removably attached to the at least one substantially U-shaped carrier, the at least one substantially U-shaped carrier having a plurality of notches capable of receiving the plurality of attachment members of at least one follower block such that the at least one substantially U-shaped carrier is removably attached to the at least one follower block and capable of slidably receiving a portion of the means for substantially enclosing both the first gear means and the second gear means, the one or more fittings capable of mating with various components of furniture systems such that furniture can be substantially lifted by the adjustable lifting apparatus.

9. An adjustable lifting apparatus as set forth in claim 1 further comprising stabilizing means capable of substantially stabilizing the adjustable lifting apparatus.

10. An adjustable lifting apparatus comprising:

an elongated threaded member having an end and an opposite end;

at least one follower block comprising an end portion, and intermediate portion having a plurality of attachment members, and an opposite end portion, the at least one follower block having a threaded aperture for receiving the elongated threaded member;

an elongated first housing member substantially enclosing the elongated threaded member and the at least one follower block, the elongated first housing member having an end portion, an opposite end portion, and an intermediate portion having a pair of first elongated apertures and the pair of second elongated apertures, both the pair of first elongated apertures and the pair of second elongated apertures capable of slidably receiving the plurality of attachment members of the at least one follower block;

a base member attached to the opposite end portion of the elongated first housing member, the base member having a cavity for partially receiving an opposite end of the threaded member, whereby the attachment between the base member and the opposite end portion of the elongated first housing member provides for relative movement between the base member and the elongated first housing member;

gear means capable of rotating the elongated threaded member and thereby linearly moving the at least one follower block;

a second housing member substantially enclosing the gear means, the second housing member having a top portion, an intermediate portion, and a bottom portion attached to the end portion of the elongated first housing member, whereby the attachment between the second housing member and the elongated first housing member provides for relative movement between the second housing member and the elongated first housing member;

at least one reinforcing means capable of slidably receiving a portion of the elongated first housing member, the reinforcing means having means for receiving an attachment member such that a collar is removably attached to the at least one follower block; and one or more fittings removably attached to the reinforcing means by fastening means, the one or more fittings capable of mating with various components of furniture systems such that furniture can be substantially lifted by the adjustable lifting apparatus.

11. An adjustable lifting apparatus as set forth in claim 10 wherein the elongated threaded member comprises a worm screw.

12. An adjustable lifting apparatus as set forth in claim 10 wherein the elongated first housing member is comprised of substantially square tubing.

13. An adjustable lifting apparatus as set forth in claim 10 wherein the elongated first housing member is comprised of substantially round tubing.

14. An adjustable lifting apparatus as set forth in claim 11 wherein the gear means comprises a first gear member meshed with a second gear member at a right angle to the first gear member, the first gear member rigidly attached to the end of the worm screw, the second gear member, rigidly attached to an end of a shaft, the shaft having an opposite end portion capable of receiving a crank member.

15. An adjustable lifting apparatus as set forth in claim 14 wherein the opposite end portion of the shaft has a hexagonal shaped cross section.

16. An adjustable lifting apparatus as set forth in claim 14 wherein the first gear member and the second gear member comprise miter gears with a 20° pressure angle.

17. An adjustable lifting apparatus as set forth in claim 10 wherein the plurality of attachment members comprise a plurality of thumb screws having a head portion and a partially threaded shaft portion, the plurality of thumb screws received within a plurality of threaded apertures of the intermediate portion of the at least one follower block.

18. An adjustable lifting apparatus as set forth in claim 10 further comprising stabilizing means capable of substantially stabilizing the adjustable lifting apparatus.

19. An adjustable lifting apparatus as set forth in claim 18 wherein the stabilizing means comprises a substantially L-shaped stabilizing arm having a plurality of grooves, and locking means, the substantially L-shaped stabilizing arm adjustably attached to the top portion of the second housing member.

20. An adjustable lifting apparatus as set forth in claim 19 wherein the locking means comprises the plurality of grooves of the substantially L-shaped stabilizing arm in combination with a U-shaped frame member attached to the top of the second housing member, a release lever attached to the U-shaped stabilizing arm capable of being adjustably received within the U-shaped frame member so as to allow relative movement between the release lever and the U-shaped stabilizing arm such that the plurality of grooves of the substantially L-shaped stabilizing arm are capable of receiving the release lever.

21. An adjustable lifting apparatus as set forth in claim 10 wherein the reinforcing means is a collar.

22. An adjustable lifting apparatus as set forth in claim 10 wherein the fastening means removably attaching the one or more fittings to the collar include a plurality of threaded members in combination with a plurality of threaded apertures in a plate member carried by the carrier.

23. An adjustable lifting apparatus as set forth in claim 10 wherein the second housing member is attached to the elongated first housing member off-center such that the second housing member and the corresponding gear means can be moved with respect to the elongated first housing member, whereby the off-center attachment between the second housing member and the elongated first housing member provides relative movement between the second housing member and the elongated first housing member.

24. An adjustable lifting apparatus as set forth in claim 10 wherein the base member is attached to the elongated first housing member off-center such that the base member can be moved with respect to the elongated first housing member, whereby the off-center attachment between the base member and the elongated first housing member provides for relative movement between the base member and the elongated first housing member.

25. An adjustable lifting apparatus as set forth in claim 10 wherein the reinforcing means is a U-shaped carrier.

26. An adjustable lifting apparatus as set forth in claim 25 wherein the fastening means removably attaching the one or more fittings to the U-shaped carrier comprise a plurality of threaded members in combination with a plurality of threaded apertures of the U-shaped carrier.

27. An adjustable lifting apparatus as set forth in claim 10 wherein the fastening means removably attaching the one or more fittings to the collar include a dovetail slot in provided by a portion of the collar in combination with a dovetail key of the one or more fittings, the dovetail slot capable of slidably receiving the dovetail key.

28. An adjustable lifting apparatus as set forth in claim 25 wherein the fastening means removably attaching the one or more fittings to the U-shaped carrier comprise a dovetail slot of the U-shaped carrier in combination with a dovetail key of the one or more fittings, the dovetail slot capable of slidably receiving the dovetail key.

* * * * *